US006973675B2

(12) United States Patent
Cheng

(10) Patent No.: US 6,973,675 B2
(45) Date of Patent: Dec. 13, 2005

(54) STRIPPABLE MULTI-LAYER MEDICAL GLOVE

(75) Inventor: Yung-Chu Cheng, Taipei (TW)

(73) Assignee: Motex Healthcare Corp., Taipei (TW)

( * ) Notice: Subject to any disclaimer, the term of this patent is extended or adjusted under 35 U.S.C. 154(b) by 0 days.

(21) Appl. No.: 10/934,535

(22) Filed: Sep. 7, 2004

(65) Prior Publication Data

US 2005/0060787 A1 Mar. 24, 2005

(30) Foreign Application Priority Data

Sep. 23, 2003 (TW) ..... 92217151 U

(51) Int. Cl.[7] ..... A41D 19/00

(52) U.S. Cl. ..... 2/161.7

(58) Field of Search ..... 2/161.6, 161.7, 2/167, 169; 428/36.91

(56) References Cited

U.S. PATENT DOCUMENTS 4,061,709 A * 12/1977 Miller et al. ..... 264/293
4,696,065 A * 9/1987 Elenteny ..... 2/168
5,545,451 A * 8/1996 Haung et al. ..... 428/36.8
6,360,373 B1 * 3/2002 Rehn et al. ..... 2/161.6

* cited by examiner

*Primary Examiner*—Katherine M. Moran
(74) *Attorney, Agent, or Firm*—Troxell Law Office, PLLC

(57) ABSTRACT

It is a medical glove being a plurality of layers (individual gloves) sleeved one over another in such a way that the outer layers can be stripped to unveil new clean exteriors.

4 Claims, 9 Drawing Sheets

STRIPPABLE MULTI-LAYER MEDICAL GLOVE

BACKGROUND AND SUMMARY OF THE INVENTION

The present invention relates to a medical glove and more particularly, to a strippable multi-layer medical glove that is strippable layer by layer for repeated use.

A regular medical glove is formed of latex or plastic material. In order to prevent contamination, a medical glove has to be thrown away after each use. However, when there are a lot of patients, it is inconvenient for a doctor or a medical person to be replacing gloves before every examination. Doing so wastes a lot of time and may lead to serious problems in case of an emergency.

The present invention has been accomplished under the above circumstances in view, thus it is the main objective of the present invention to provide a medical glove for repeated use. To accomplish such objective, the present invention is comprised of a plurality of individual gloves, hereon referred to as layers, sleeved one over another in such a way that outer glove can be removed to unveil a clean new surface. With such a glove, the user can use the same glove on multiple patients without infecting one patient with whatever maybe present in another. Not only does it save the user's time and money, it does so while being as clean as a new glove. Furthermore, it gives the user option of removing different numbers of layers to suit the needs in different situations.

DETAILED DESCRIPTION OF THE INVENTION

Figure 1:
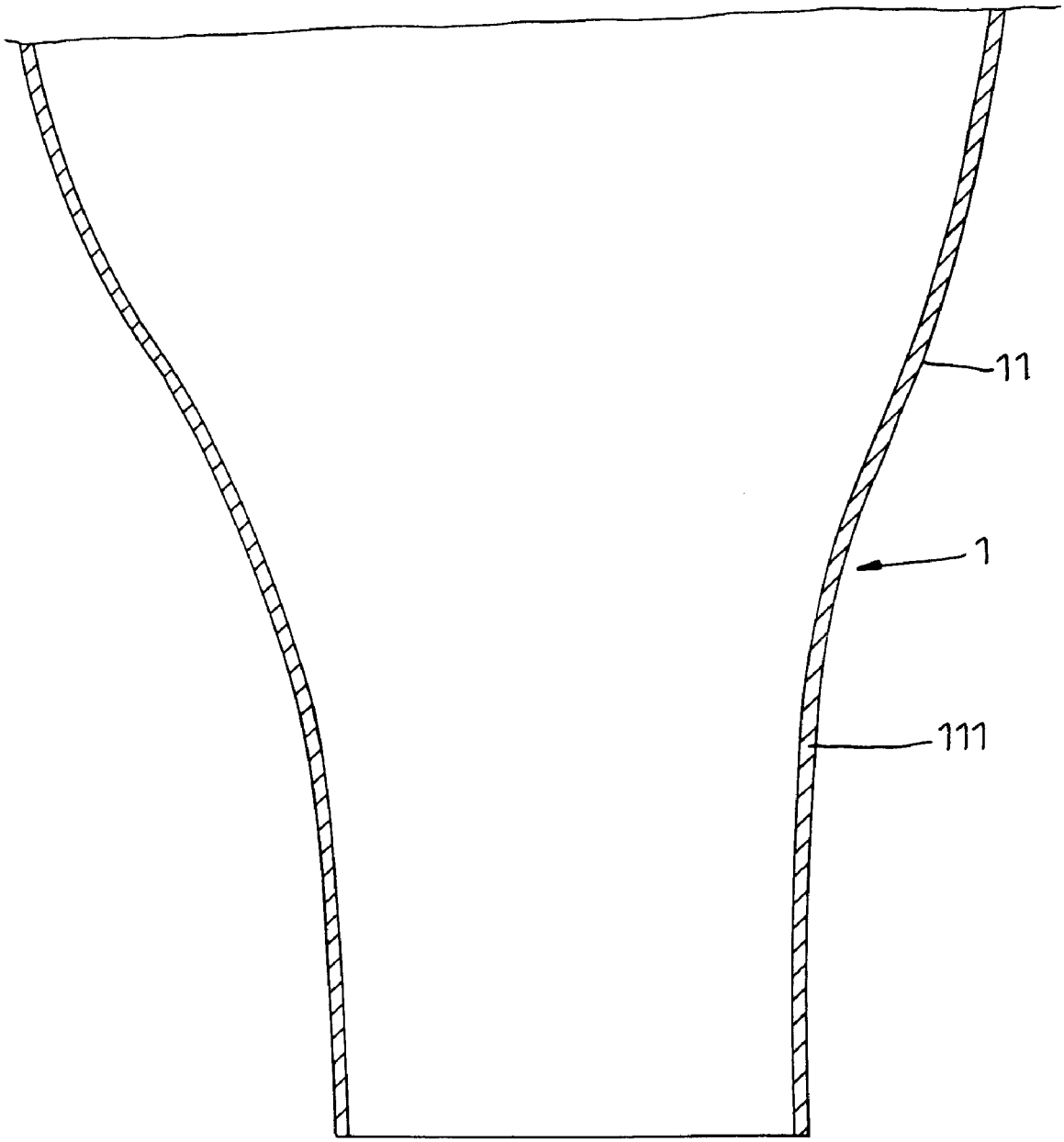
FIG. 1 is a sectional view of the outer layer of the strippable multi-layer medical glove, as according to the present invention.

Referring to FIG. 1, a strippable multi-layer medical glove 1 is shown comprising of a plurality of layers 11~15 sleeved one over another. The layers 11~15 include an outer layer 11, an inner layer 15, and a plurality of intermediate layers 12~14 sleeved one over another between the outer layer 11 and the inner layer 15. The length of the cuff 151 of the inner layer 15 is the longest. The length of the cuff 111 of the outer layer 11 is the shortest. The cuffs 121,131,141 of the intermediate layers 12~14 are respectively from the shortest to the longest, but are shorter than the length of the cuff 151 of the inner glove 15 and longer than the length of the cuff 111 of the outer glove 11.

After one use, the outermost layer 11 of the strippable multi-layer medical glove 1 is then stripped from the glove (apart from layers 12~15), to unveil the clean new surface of layer 12. It is then that the strippable multi-layer medical glove 1 can be used as a new glove.

The inner layer 15 has a thickness of about 0.08 mm (fits ASTM D3578-00). The other layers 11~14 have a thickness of within 0.03 mm~0.1 mm. For example, if the thickness of the inner layers 15 is 0.08 mm and the thickness of the other layers 11~14 are 0.05 mm, then the total thickness of the strippable multi-layer medical glove 1 is 0.28 mm. A glove having the thickness of 0.2 mm is comfortable and convenient.

To make this glove, a glove mold is first immersed into a bath to be covered with a coat of latex or plastic substance. The mold is then dried to turn the coat into the outer layer 11 (see FIG. 1).

Figure 2:
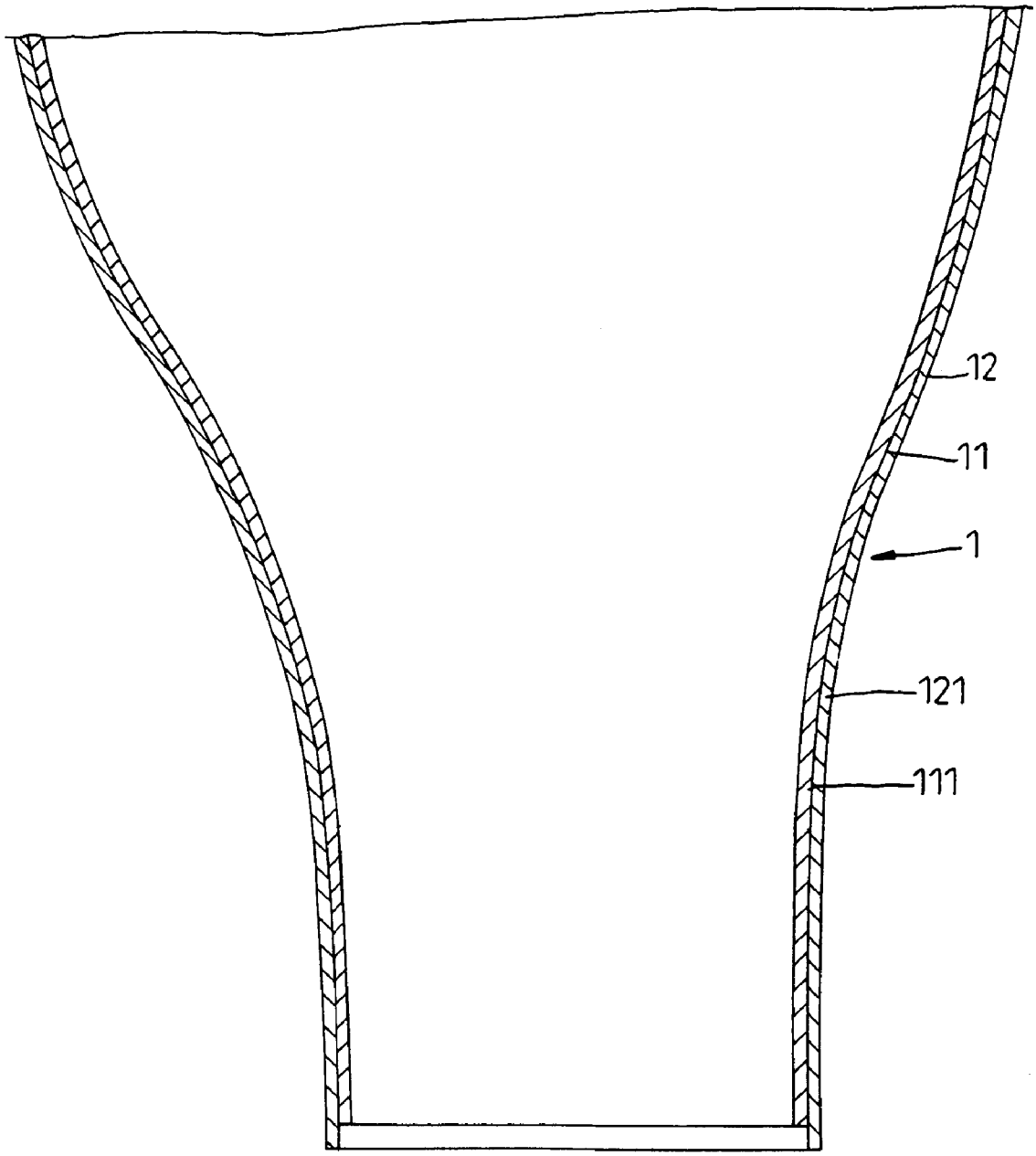
FIG. 2 is a sectional view showing the first intermediate layer formed on the outer layer, as according to the present invention.
Figure 3:
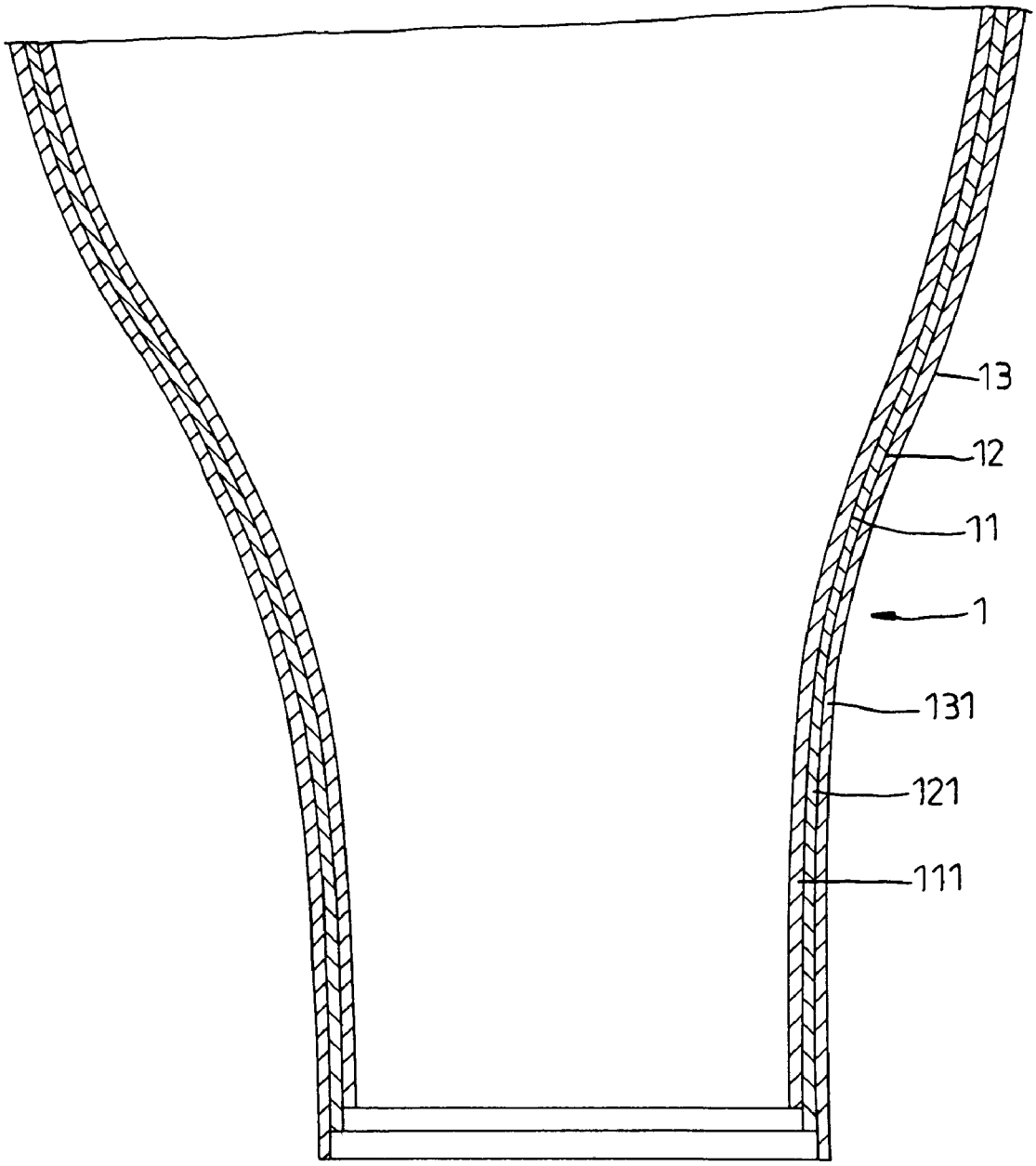
FIG. 3 is a sectional view showing the second intermediate layer formed on the first intermediate layer over the outer layer, as according to the present invention.
Figure 4:
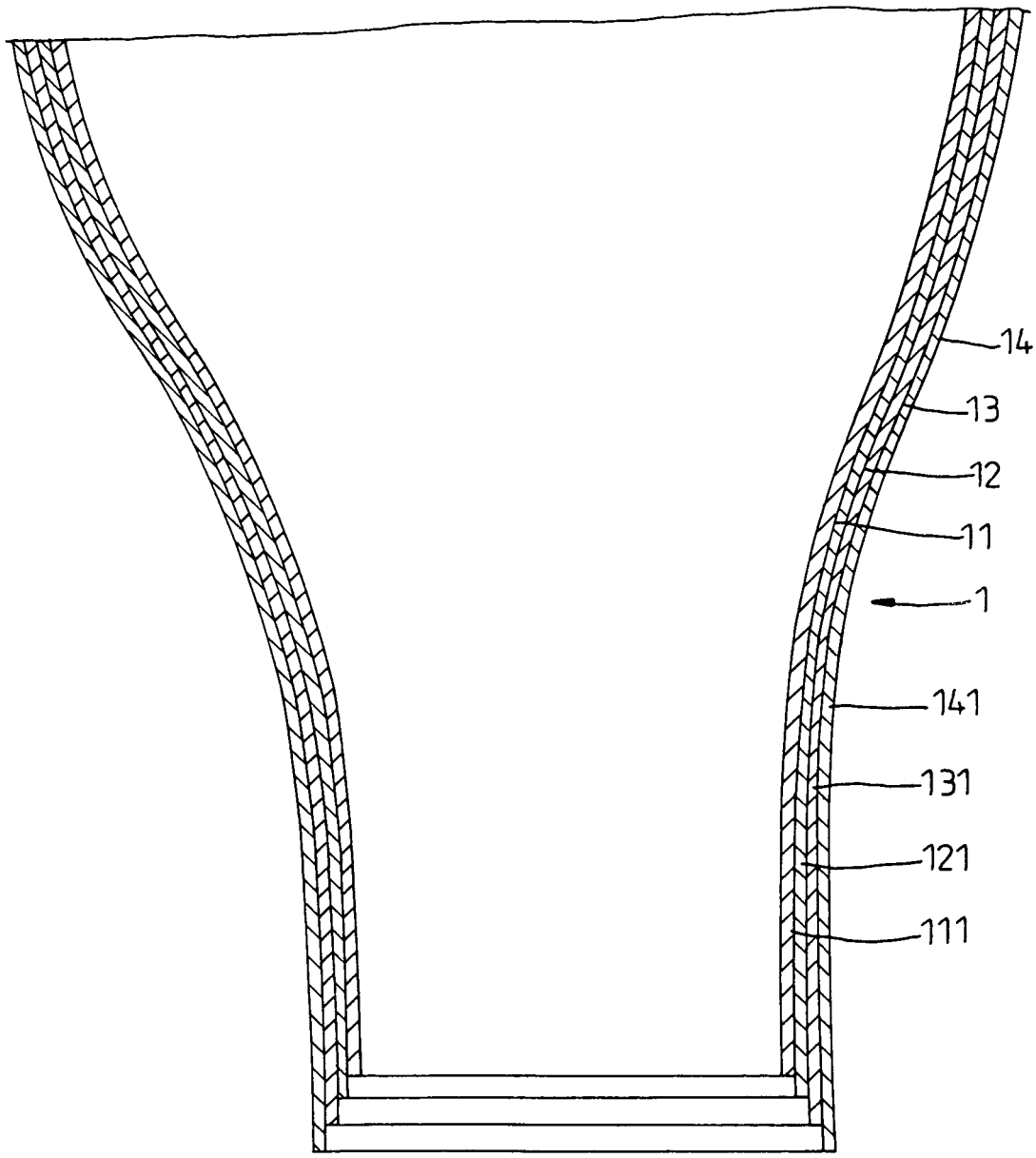
FIG. 4 is a sectional view showing the third intermediate layer formed on the second intermediate layer outside the outer layer and the first intermediate layer, as according to the present invention.
Figure 5:
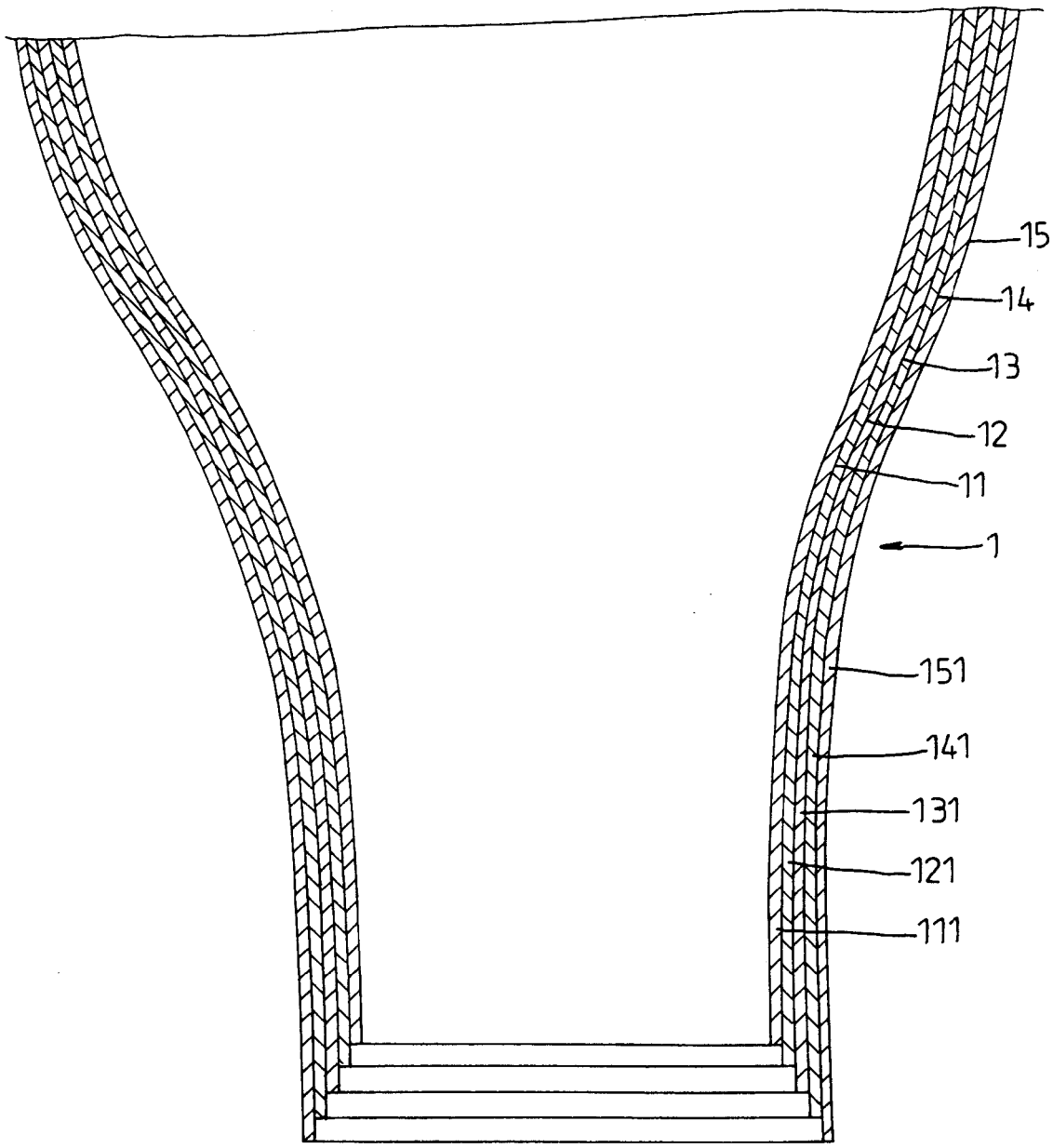
FIG. 5 is a sectional view showing an inner layer formed on the third intermediate layer outside the outer layer, the first intermediate layer and the second intermediate layer, as according to the present invention.
Figure 6:
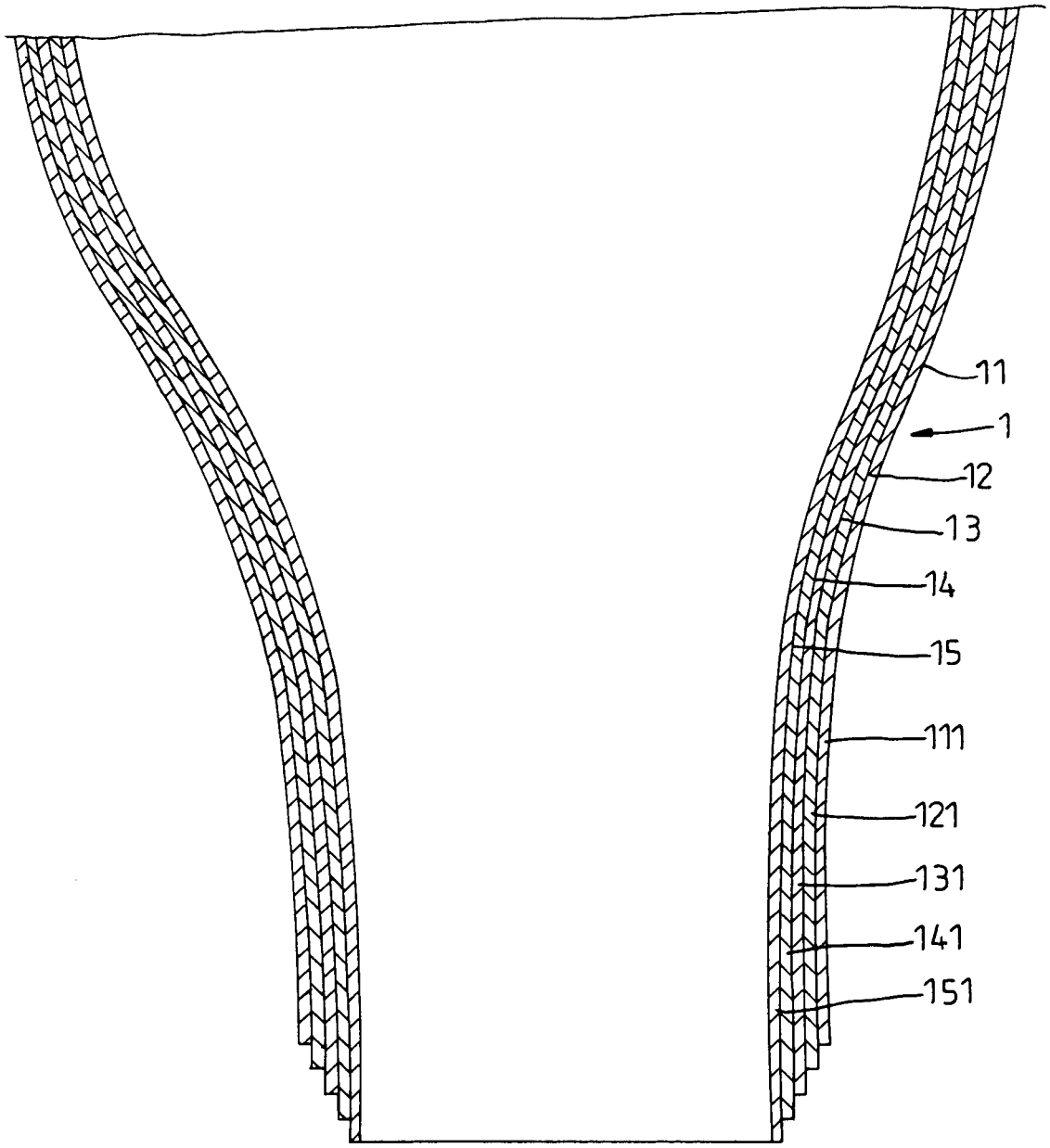
FIG. 6 corresponds to FIG. 5, showing the individual gloves turned inside out.
Figure 7:
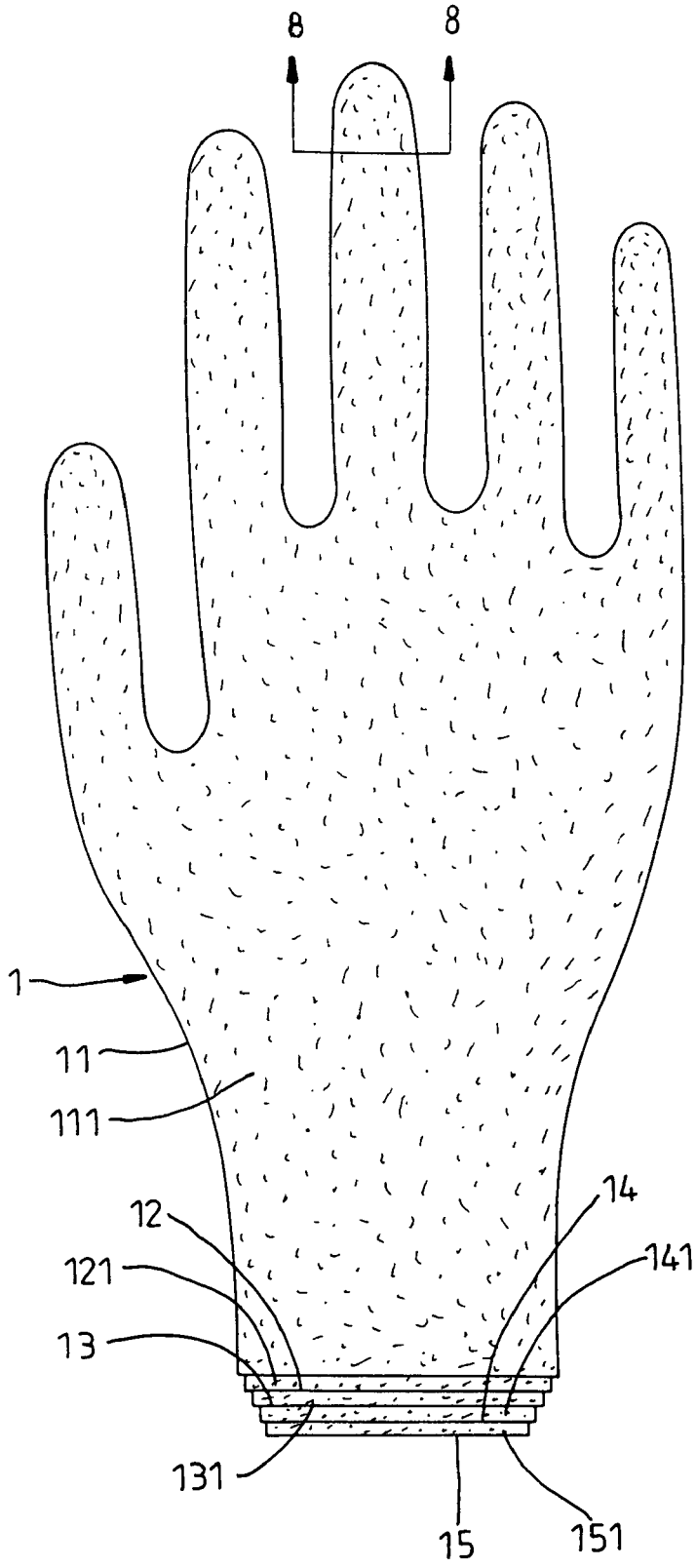
FIG. 7 is a plain view of the strippable multi-layer medical glove as according to the present invention.

After the outer layer's formation, the mold is then covered with a coat of stripping substance over the outer layer, and is immersed again into the bath. The second coat then dries to become the first intermediate layer 12 (see FIG. 2). This process of coating with stripping substance and coating with latex or plastic substance is then repeated to form successively the following intermediate layers 13~15 (see FIGS. 3~5). After all layers are formed, the glove is almost made.

Figure 8:
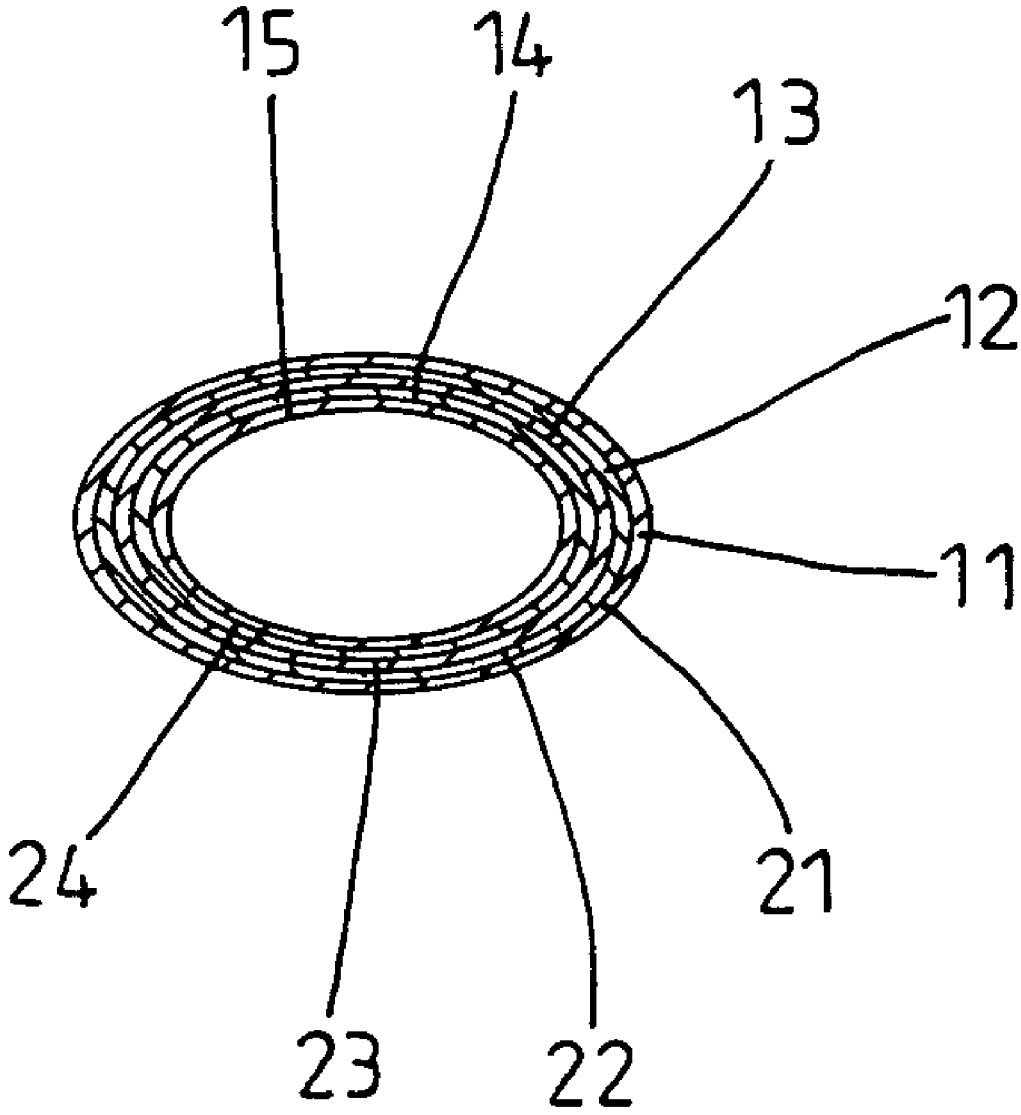
FIG. 8 is a sectional view at an enlarged scale taken along line 8—8 of FIG. 7.
Figure 9:
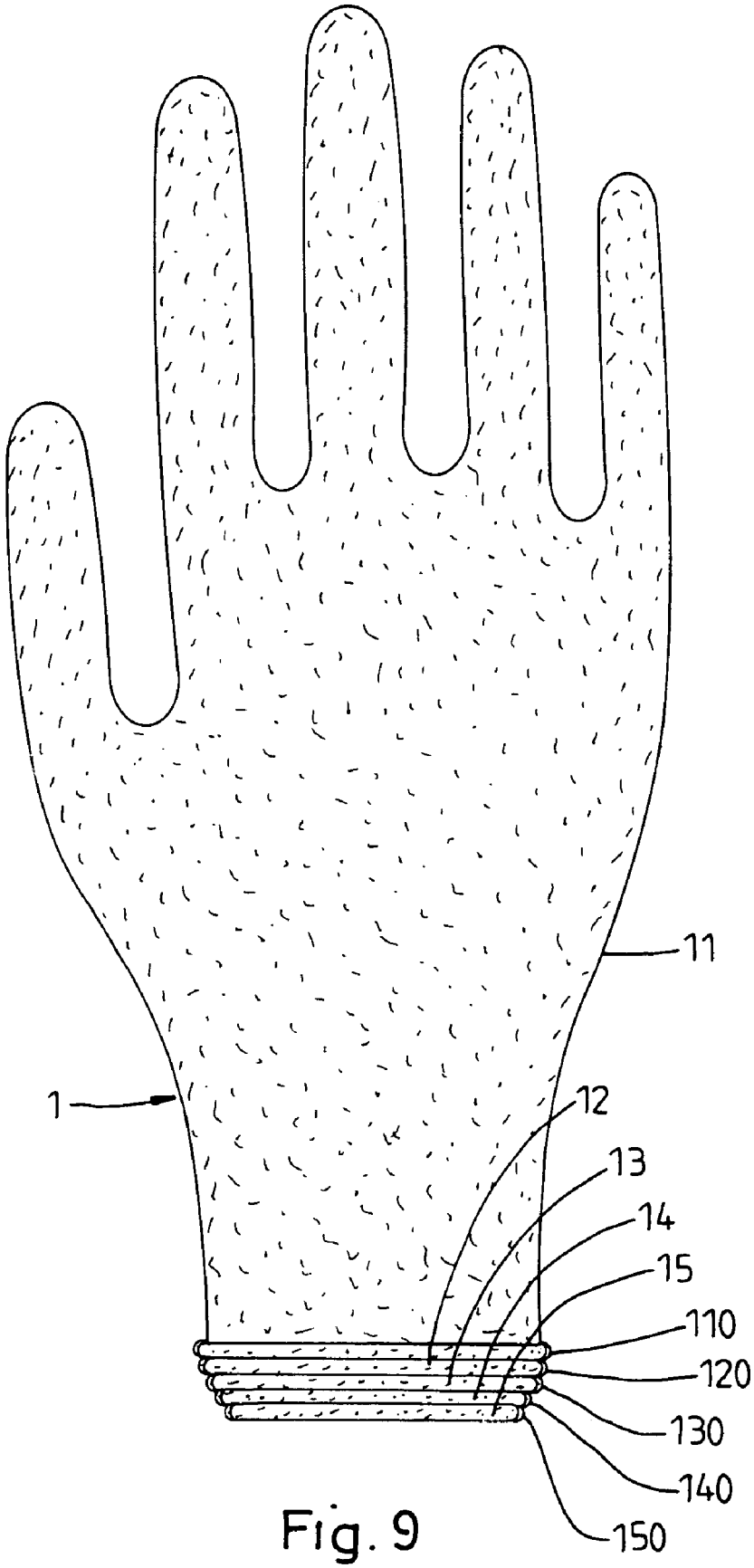
FIG. 9 is a plain view of an alternative form of the strippable multi-layer medical glove, which shows a bead formed in the cuff of each layer, as according to the present invention.

Next, the glove is removed from the mold and turned inside out. Thin layers of stripping material 21~24 are respectively formed between each two adjacent individual gloves (see FIG. 8). At this point, two processes can be done (not exclusive of one another). One is that the inner layer can then be treated to be anti-microbial. Another is that after the formation of the layers and before vulcanizing the cuff 111~151 of each of the individual layers 11~15, the cuffs 111~151 may be rolled up to form respective beads 110~150. The glove is then finished.

While only one embodiment of the present invention has been shown and described, it will be understood that various modifications and changes could be made thereunto without departing from the spirit and scope of the invention disclosed. For example, the individual gloves may be so arranged that the outer glove has the longest cuff and the inner glove has the shortest cuff.

As indicated above, the invention provides a strippable multi-layer medical glove that achieves the following advantages:

1. Due to the fact that the user can remove one individual layer after each use of the strippable multi-layer medical glove, the strippable multi-layer medical glove can be used repeatedly. Therefore, the invention saves much time and cost from replacing the glove.

2. Adaptable for use in different situations, the glove can be stripped of multiple layers by the user for meet the user's needs.

3. Unless left with the last layer, the inner layer, at least two layers of protection, equivalent with the protection of two gloves, are protecting the hand. This is providing safer protection.

What is claimed is:

1. A strippable multi-layer medical glove comprising:

a) a plurality of individual glove layers sleeved together and having:

i) an inner layer;

ii) a plurality of intermediate layers, each of the plurality of intermediate layers is removably located around an exterior surface of the inner layer; and iii) an outer layer removably located around the plurality of intermediate layers; and b) a plurality of stripping material layers, one of the plurality of stripping material layers is located between each pair of adjacent individual glove layers of the plurality of individual glove layers.

2. The strippable multi-layer medical glove according to claim 1, wherein each of the plurality of individual glove layers having a cuff length, each cuff length has a different length and the cuff length of each of the plurality of individual glove layers increases in length moving from the outer layer to the inner layer.

3. The strippable multi-layer medical glove according to claim 1, wherein each of the plurality of Individual glove layers having a cuff including a bead located around an outer periphery thereof.

4. The shippable multi-layer medical glove according to claim 1, wherein the inner layer has a thickness of 0.08 mm, and each of the plurality of intermediate layers and the outer layer has a thickness between 0.03 mm and 0.10 mm.

* * * * *